United States Patent [19]

Gladenbeck et al.

[11] 4,022,010

[45] May 10, 1977

[54] HIGH-STRENGTH ROPE

[75] Inventors: Jürgen Gladenbeck, Bonn-Rottgen; Gerald Müller, Cologne, both of Germany

[73] Assignee: Felten & Guilleaume Carlswerk AG, Cologne, Germany

[22] Filed: Nov. 17, 1975

[21] Appl. No.: 632,359

[30] Foreign Application Priority Data

Nov. 22, 1974 Germany ..... 2455273

[52] U.S. Cl. ..... 57/149; 57/140 R

[51] Int. Cl.[2] ..... D02G 3/04

[58] Field of Search ..... 57/140 R, 140 C, 140 BY, 57/144, 149, 152, 153

[56] References Cited

UNITED STATES PATENTS

| | | | |
|---|---|---|---|
| 1,759,410 | 5/1930 | Marston | 57/152 X |
| 2,755,214 | 7/1956 | Lyons et al. | 57/140 BY X |
| 2,769,300 | 11/1956 | Luttge | 57/144 X |
| 3,323,301 | 6/1967 | Jackson et al. | 57/152 X |
| 3,380,243 | 4/1968 | Stanton | 57/144 |
| 3,429,354 | 2/1969 | Brooks | 57/140 BY X |
| 3,455,100 | 7/1969 | Sidles et al. | 57/152 |
| 3,486,546 | 12/1969 | Sidles et al. | 57/140 BY X |
| 3,565,127 | 2/1971 | Nicely | 57/140 BY X |
| 3,911,785 | 10/1975 | Hood | 57/144 X |

*Primary Examiner*—Donald Watkins
*Attorney, Agent, or Firm*—Michael J. Striker

[57] ABSTRACT

A high-strength rope, strand or yarn includes a core component, such as a fiber or a plurality thereof, of elastic synthetic plastic material, the core component having a predetermined length. A plurality of envelope components surrounds the core component and includes filaments of high tensile strength synthetic plastic material, the filaments being of substantially equal length exceeding the predetermined length. The envelope components may be in form of strands or yarns, each including a plurality of high tensile strength filaments. The rope may be soaked with flexible wear-resistant material, and a jacket of flexible, wear-resistant synthetic plastic material may surround the rope or the strands, yarns or filaments which constitute the same.

18 Claims, 1 Drawing Figure

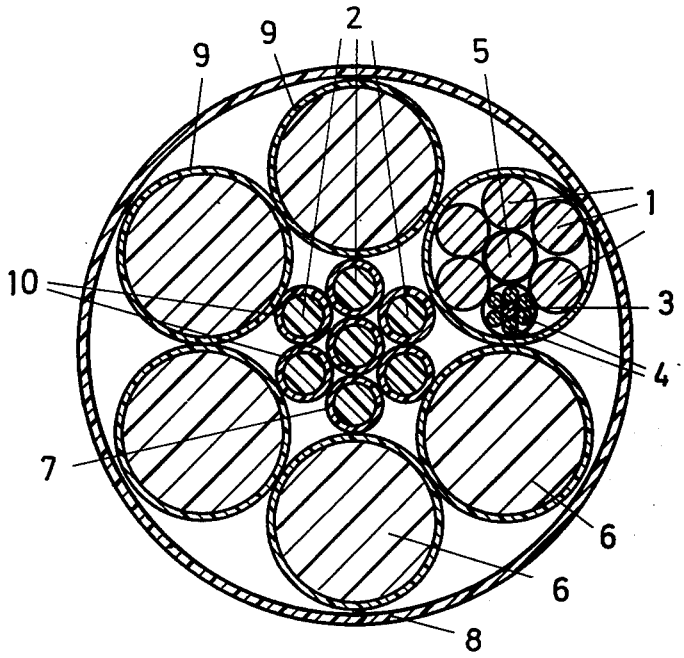
2
9
9
5
1
10
3
4
7
6
6
8

HIGH-STRENGTH ROPE

BACKGROUND OF THE INVENTION

The present invention relates to a rope, and particularly to a rope which may be used for hoisting heavy objects, such as by cranes, derricks and similar devices.

There are already in widespread use cables or ropes of different constructions and of various materials. The selection of a particular rope for a particular purpose will depend on the environment in which the rope is to be used and also on the load which is applied to the rope. So, for example, there are already known ropes which are used in cranes, derricks, elevators and conveying arrangements, such ropes being almost exclusively made of steel wires which are intertwisted in form of yarns and strands to form the rope. While it is true that such conventional ropes are capable of withstanding substantial tensile stresses so that relatively heavy objects can be lifted using such ropes, such ropes are also disadvantageous in some respects. So, for instance, the steel material of such ropes is sensitive to the influences of the ambient atmosphere and it may corrode, so that it is necessary to inspect and protect such ropes or cables at frequent intervals, which involves substantial expense in terms of labor and material.

On the other hand, there are already known ropes of synthetic plastic material which are also capable of withstanding substantial loads. However, such ropes or cables of synthetic plastic material are disadvantageous in that they stretch, when subjected to load, to a great degree, such as by 35 to 50%. It will be appreciated that such ropes or cables are not suited for use in hoisting devices, such as elevators, cranes, derricks, or in conveying arrangements, especially inasmuch as it is rather difficult to handle the objects to be lifted or transported because of the elastic yieldability of the rope of synthetic plastic material.

Another type of high tensile strength rope or cable of synthetic plastic material is known from the published German Pat. No. 2,222,312 which discloses a rope which includes a multitude of mainly carrying filaments of synthetic plastic material, and inserts or jackets of fibrous materials. The inserts or jackets are made of highly stretchable, but unstretched or only partially stretched materials, and such inserts or jackets are provided in such an amount and are so arranged that, when the rope of synthetic plastic material is overloaded, then a gradual reduction of the potential energy of the filaments of synthetic plastic material occurs in the overloaded regions of the rope of synthetic plastic material. In this rope, the inserts or jackets are made of metal or metal alloys, or of graded sections of not fully stretched identical or different synthetic plastic material monofilaments. This elastic rope is to be used predominantly on ships, and the reason for providing the inserts or jackets is to prevent damage to the ships or injury to the personnel which may otherwise occur subsequent to the rupture of the ropes due to the quick movement of the ends of the rope. However, even such a rope has a high degree of elasticity and, therefore, is not suited for use in connection with cranes, derricks, elevators and conveying arrangements.

A relatively recent development is synthetic plastic material of high tensile strength, which is a high-strength aromatic polyamide which is marketed under the designation PRD-49, or, more recently, Kevlar 49. It has been already proposed to make support ropes of such a synthetic plastic material. However, inasmuch as experiments with this new material have established that the maximum loading capacity of the rope cannot be obtained when the filaments of the high tensile strength material of which it consists are intertwisted or convoluted, this novel rope includes essentially parallel filaments. The parallel filaments are surrounded by a synthetic plastic material jacket which protects those filaments and holds them together. However, this rope or cable has only low flexibility, and short life span when subjected to bending, so that this rope is not suited for use in connection with cranes, derricks and similar lifting and transporting devices.

SUMMARY OF THE INVENTION

Accordingly, it is an object of the present invention to avoid the disadvantages of the prior-art ropes or cables.

More particularly, it is an object of the present invention to provide a high-strength rope which is simple in construction and reliable in operation.

It is a further object of the present invention to provide a rope which is specially suited for use in connection with cranes, derricks, elevators and similar hoisting and transporting arrangements.

It is a concomitant object of the present invention to provide a high-strength rope which has good flexibility.

It is yet another object of the present invention to provide a rope having high wear-resistance.

It is still another object of the present invention to provide a rope which is essentially insensitive to the influences of the ambient air.

A further object of the present invention is to provide a rope which incorporates a plurality of high-strength filaments and which utilizes the high strength of such filaments to the greatest possible degree.

It is also an object of the present invention to provide a rope which has a long life span even when subjected to frequent and substantial bending stresses.

In pursuance of these objects and others which will become apparent hereafter, the present invention resides, briefly stated, in a high-strength rope which comprises at least one core component of elastic synthetic plastic material having a predetermined length, and a plurality of envelope components including filaments of high tensile strength synthetic plastic material, the filaments being of substantially equal lengths exceeding the predetermined length. The rope may be constituted by individual filaments or fibers, or of yarns or strands of such fibers. The material of the core component may be stretched, and it may be made of, for instance, polyamide, polyester or polypropylene, whereas the material of the high-strengh filaments is an aromatic polyamide.

The result of this arrangement is that, when the rope is subjected to load, each of the high-strength rope envelope components is subjected to the same stress as the other envelope components, whereas the shorter core components also contribute a part to the tensile strength of the rope due to the higher stretching thereof. On the other hand, if the core components, which are necessarily shorter than the envelope components twisted around the same, were also made of the synthetic plastic material of high tensile strength, then these core components would be subjected to higher stretching and thus to higher tensile forces than the envelope components so that the core components would rupture at relatively low loadings of the rope, which would result in relatively rapid rupture of the entire rope.

In a particularly advantageous embodiment of the present invention, a strand has a core component including synthetic plastic material fibers of high yieldability, and yarns of the high-strength synthetic plastic material, which has low stretchability, are twisted around the core component. This embodiment of the present invention satisfies the theoretical requirement that the high-strength rope components have the same length. This embodiment of the invention is especially suited for ropes of an intermediate diameter.

According to a further currently preferred embodiment of the present invention, the rope contains a core strand which includes exclusively fibers of the highly elastically yieldable synthetic plastic material. A plurality of strands each including a multitude of the high-strength filaments is then twisted around the core strand. This embodiment of the present invention is very advantageous in such rope construction in which the core strand is shorter than the envelope strand.

It is proposed according to a further embodiment of the present invention that each of the yarns of the rope have a core including fibers of the stretchable synthetic plastic material, and that a single layer of filaments of the high strength synthetic plastic material be twisted or convoluted around the core.

This latter embodiment of the invention is advantageously used in ropes for heavy applications, such ropes having diameters greater than 20 mm. Thus, even in this arrangement, the high-strength filaments have the same lengths.

In a further currently preferred embodiment of the present invention, the strands or the yarns of the rope are soaked with a flexible wear-resistant synthetic plastic material, such as with polyurethane. This feature of the present invention results in an increase of the inner wear-resistance of the rope. As a result of this, the life span of the rope is substantially increased, particularly when the rope is frequently or constantly run over pulleys of relatively small diameters, or when the rope is often taken up on and paid out from a rope storing drum.

In a further currently preferred embodiment of the invention, the rope and/or the strands and/or the yarns are coated with a jacket of flexible and wear-resistant synthetic plastic material, such as polyurethane, polyamide or silicone rubber. As a result of this feature of the present invention, the wear-resistance of the rope against external mechanical influences is substantially increased. Advantageously, thin ropes, having diameters up to 8 mm, are completely coated with a thin jacket. Ropes having diameters up to approximately 20 mm are not, to advantage, coated in their entirety, but rather the rope strands are individually coated with a jacket of synthetic plastic material. In this manner, the flexibility of the rope and the durability of the jacket are increased, particularly when the rope is subjected to cyclical loading by bending forces. It can be advantageous, for yet thicker ropes (more than 20 mm in diameter) to coat the yarns of which the strands consist with thin jackets. In this manner, again the flexibility and the durability of the rope is increased.

The rope of the present invention also possesses additional other advantages in addition to those enumerated above. Thus, for instance, compared to the conventional ropes, the rope of the present invention can be subjected to higher loads with the same safety factor. The excellent flexibility and the resistance to cyclical bending forces of which the rope of the present invention is possissed render it also possible to train the rope about smaller pulleys than heretofore known, and to also use take up drums of smaller diameters which, in turn, renders it possible to use less costly transmissions. Furthermore, the rope of the present invention weighs approximately five times less than a comparable steel wire rope. On the other hand, when the rope of the present invention is compared with the comparable conventional synthetic plastic material ropes, the stretching behavior of the former is substantially better than that of the latter. Namely, the stretching in the operating range amounts to approximately one-tenth of that of a comparable conventional synthetic plastic material rope. The rope of the present invention stretches completely linearly up to the rupture point without substantial plastic deformation. This, in turn, renders it possible to better utilize the strength of the material of the rope, particularly when the rope is used as a towing rope for ships, airplanes or gliders.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawing.

BRIEF DESCRIPTION OF THE DRAWING

The sole FIGURE of the drawing is a somewhat diagrammatic cross sectional view of the rope of the present invention.

DESCRIPTION OF THE PREFERRED EMBODIMENTS

Referring now to the drawing in detail, it may be seen that the illustrated example of the rope of the present invention includes a central strand 7 and six additional strands 6 which surround the central strand 7. The central or core strand 7 consists of seven yarns 2 each of which is made of synthetic plastic material fibers having high elastic yieldability, such as of stretched or unstretched polyamide polyester or polypropylene. A jacket 10 of a flexible and wear-resistant synthetic plastic material, such as polyurethane, polyamide or silicone rubber, is shown to surround each of the yarns 2 for illustration purpose. Six strands 6 of substantially the same length are convoluted around the core strand 7 and again, for illustration purposes, a synthetic plastic material jacket 9 is shown to surround each of the strands 6. In the illustrated embodiment, a synthetic plastic material jacket 8 is shown to surround all of the strands 6 and 7. For practical purposes, it will be sufficient to use only one of the illustrated synthetic plastic material jackets 8, 9 or 10, particularly since the utilization of all of them would unnecessarily reduce the flexiblility of the rope without achieving any advantageous results. The jackets 8, 9 or 10 are preferably applied to the respective components by extrusion using an extrusion die and applying subatmospheric pressure. If such a procedure is used, the respective jackets 8, 9 or 10 will not have the circular configuration illustrated in the drawing, but rather will follow the outer contour of the respective components. When the entire rope is coated, then the thickness of the jacket 8 may be smaller than 1 mm, whereas the thickness of the jacket 9 around the individual strands 6 or 7 is generally smaller than 0.5 mm. When the rope is of a substantial diameter, then it is advantageous to coat the individual yarns, in which event the thickness of the jacket 10 may amount to several tenths of a millimeter.

The drawing also illustrates the internal construction of an envelope strand 6. The strand includes an inner yarn 5 which may be made of fibers of a synthetic plastic material having a high degree of elastic yieldability. A plurality of yarns 1 made of aromatic polyamide and having high tensile strength and low stretchability is arranged around the core yarn 5. The material for the yarns 1 is, for instance, polyparaphenylene diamine terephthalate or a similar material obtained by reacting m-phenylene diamine with terephthalic acid. A suitable aromatic polyamide is currently marketed by the du-Pont company under the designation PRD-49 and lately also as Kevlar 49 . For ropes having diameters exceeding 20 mm, it can be advantageous when also the yarns 1 each have an inner fiber 3 made of a synthetic plastic material with a high degree of stretchability, and to provide a plurality of filaments 4 of the aromatic polyamide which are twisted around the core fiber 3.

It will be understood that each of the elements described above, or two or more together, may also find a useful application in other types of constructions differing from the type described above.

While the invention has been illustrated and described as embodied in a rope for use in hoisting devices, it is not intended to be limited to the details shown since various modifications and structural changes may be made without departing in any way from the spirit of the present invention.

Without further anyalysis, the foregoing will so fully reveal the gist of the present invention that others can by applying current knowledge readily adapt it for various applications without omitting features that, from the standpoint of prior art, fairly constitute essential characteristics of the generic or specific aspects of this invention.

What is claimed as new and desired to be protected by Letters Patent is set forth in the appended claims:

1. A high-strength rope, comprising at least one core component of elastic synthetic plastic material having a predetermined length; and a plurality of envelope components including filaments of high tensile strength aromatic polyamide, said filaments being of substantially equal lengths exceeding said predetermined length.

2. A rope as defined in claim 1, wherein said elastic material is prestretched.

3. A rope as defined in claim 1, wherein said elastic material is selected from the group consisting of polyamide, polyester and polypropylene.

4. A rope as defined in claim 1, wherein said envelope components are twisted around said core component.

5. A rope as defined in claim 1, wherein said core component includes at least one fiber; and wherein said filaments surround said fiber.

6. A rope as defined in claim 1, wherein said core component is a yarn; and wherein said envelope components each include at least one of said filaments.

7. A rope as defined in claim 1, wherein said core component is a strand; and wherein said envelope components are strands each including at least one of said filaments.

8. A rope as defined in claim 1, wherein said core component includes a plurality of fibers; and wherein said envelope components are yarns which are twisted around said core component.

9. A rope as defined in claim 1, wherein said core component is a strand of fibers; and wherein said envelope components are strands surrounding said core component.

10. A rope as defined in claim 1, wherein said envelope component includes a core of said elastic material; and a plurality of said filaments twisted around said core in a single layer.

11. A rope as defined in claim 1, wherein said core and envelope components are soaked with a flexible, wear-resistant synthetic plastic material.

12. A rope as defined in claim 1; said rope further including a jacket of a flexible, wear-resistant synthetic plastic material.

13. A rope as defined in claim 12, wherein said flexible, wear-resistant material is selected of the group consisting of polyurethane, polyamide and silicone rubber.

14. A rope as defined in claim 1, wherein said core and envelope components are surrounded by a jacket of a flexible, wear-resistant synthetic plastic material.

15. A rope as defined in claim 14 wherein said flexible, wear-resistant material is selected from the group consisting of polyurethane, polyamide and silicone rubber.

16. A high-strength rope, comprising at least one core component of elastic synthetic plastic material having a predetermined length; and a plurality of envelope components each including a core of said elastic material, and a plurality of filaments of high tensile strength synthetic plastic material which are twisted around said core in a single layer, said filaments being of substantially equal lengths exceeding said predetermined length.

17. A high-strength rope, comprising at least one core component of elastic synthetic plastic material having a predetermined length; and a plurality of envelope components including filaments of high tensile strength synthetic plastic material, said filaments being of substantially equal lengths exceeding said predetermined length, said core and envelope components being soaked with a flexible, wear-resistant material.

18. A rope as defined in claim 17, wherein said flexible, wear-resistant material is polyurethane.

* * * * *